United States Patent [19]

Marshall

[11] Patent Number: 4,833,009

[45] Date of Patent: May 23, 1989

[54] PURIFICATION OF CONDENSATION PRODUCTS

[75] Inventor: Luann R. Marshall, Wilmington, Del.

[73] Assignee: E. I. Du Pont de Nemours and Company, Wilmington, Del.

[21] Appl. No.: 173,324

[22] Filed: Mar. 25, 1988

[51] Int. Cl.[4] ..... D06M 15/41

[52] U.S. Cl. ..... 428/267; 8/560; 252/8.7; 428/96; 528/489; 528/499

[58] Field of Search ..... 528/489, 499; 428/96, 428/267; 8/560

[56] References Cited

U.S. PATENT DOCUMENTS

| | | | |
|---|---|---|---|
| 1,210,982 | 1/1917 | Pollak | 528/499 |
| 1,369,352 | 2/1921 | Pollak | 528/499 |
| 1,681,368 | 8/1928 | Seebach | 528/489 |
| 1,683,702 | 9/1928 | Seebach | 528/499 |
| 1,697,885 | 1/1929 | Seebach | 528/489 |
| 2,084,393 | 6/1937 | Hanson | 528/489 |
| 2,120,343 | 6/1938 | Wolf | 528/499 |
| 2,227,885 | 1/1941 | Hessen | 528/499 |
| 3,072,619 | 1/1963 | Turbak | 528/489 |
| 3,790,344 | 2/1974 | Frickenhaus, Jr. | 8/560 |
| 4,302,202 | 11/1981 | Sumner et al. | 8/560 |
| 4,387,207 | 6/1983 | Edwards | 528/489 |
| 4,391,718 | 7/1983 | Reitz et al. | 8/560 |
| 4,501,591 | 2/1985 | Ucci et al. | 8/560 |
| 4,592,940 | 6/1986 | Blyth et al. | 428/97 |
| 4,721,665 | 1/1988 | Dooley et al. | 528/489 |

FOREIGN PATENT DOCUMENTS 1291784 10/1972 United Kingdom .

*Primary Examiner*—James C. Cannon
*Attorney, Agent, or Firm*—Charles E. Feeny

[57] ABSTRACT

Process for removing color-formers from polymeric sulfonated phenol-formaldehyde condensation products so as provide condensation products having reduced tendencies to turn yellow and which provide stain-resistance to polyamide textile substrates which comprises dissolving a polymeric sulfonated phenolformaldehyde condensation product in a aqueous base, acidifying the resulting aqueous solution so as to form a slurry, heating the slurry so as to form a two-phase system comprising an aqueous solution and a water-soluble taffy-like material, separating the aqueous solution and the water-insoluble material from one another, and dissolving the wate-insoluble material in an aqueous base.

20 Claims, No Drawings

PURIFICATION OF CONDENSATION PRODUCTS

FIELD OF THE INVENTION

The present invention relates to a process for the purification of sulfonated phenol-formaldehyde condensation products so as to remove color-formers.

BACKGROUND OF THE INVENTION

Polyamide substrates, such as carpeting, upholstery fabric and the like, are subject to staining by a variety of agents, e.g., foods and beverages. An especially troublesome staining agent is FD&C Red Dye No. 40, commonly found in soft drink preparations. To deal with such staining problems, it has been proposed that only apply to the substrate a composition containing a sulfonated phenol-formaldehyde condensation product. For example, Blyth and Ucci, in U.S. Pat. No. 4,592,940, describe the preparation of stain-resistant nylon carpet by immersing the carpent in an aqueous solution of a sulfonated condensation polymer wherein at least 40% of the polymer units contain —$SO_3X$ radicals and at least 40% of the polymer units contain sulfone linkages. On the other hand, in U.S. Pat. No. 4,501,591, Ucci and Blyth disclose continuously dyeing polyamide carpet fibers in the presence of an alkali metal m-silicate and a sulfonated phenol-formaldehyde condensation product so as to impart stain-resistance to the dyed carpet.

However, sulfonated phenol-formaldehyde condensation products are themselves subject to discoloration; commonly they turn yellow. W. H. Hemmpel, in a Mar. 19, 1982 article in *America's Textiles* entitled *Reversible Yellowing Not Finisher's Fault,* attributes yellowing to exposure of a phenol-based finish to nitrogen oxides and/or ultraviolet radiation. Liss and Beck, in U.S. patent application Ser. No. 124,866, filed Nov. 23, 1987, prepared modified condensation products having a reduced tendency to yellow by acylating or etherifying some of the free hydroxyl groups of the sulfonated phenol-formaldehyde condensation product, separating from it lower molecular weight materials which contribute to yellowing and which are soluble in water at a pH between about 4 and 8, and dissolving the acylated or etherified condensation product in a hydroxy-containing solvent, such as ethylene glycol. That approach works well in removing color-formers; however, such solvents can place an increased biological oxygen demand on water systems.

SUMMARY OF THE INVENTION

In accordance with the present invention, color-formers are removed from sulfonated phenol-formaldehyde condensation products by dissolving the condensation product in aqueous base, acidifying the aqueous solution, heating the acidified material so as to cause phase separation, removing materials which remain water-soluble after acidification and heating, and dissolving the resultant water-insoluble material in aqueous base.

DETAILED DESCRIPTION OF THE INVENTION

The purified condensates of this invention can be prepared by dissolving the sulfonated phenol-formaldehyde condensate in an aqueous medium at an alkaline pH, e.g. 8.0–12, preferably 9.5–10.0, to give an aqueous solution containing about 10 to 40 weight percent of the sulfonated phenol-formaldehyde condensate, preferably about 25 to 30 weight of the condensate. The aqueous solution is then acidified to a pH in the range between about 2.0 to 7.5, preferably between about 5.5 and 6.5, to give a slurry. The slurry is then heated to a temperature in the range between about 50° and 65° C., preferably between about 50° and 55° C., to give a system having at least two phases comprising an aqueous solution and a water-insoluble product. Materials which remain water-soluble after acidification and heating, phenol-sulfonic acid and other low molecular weight materials, are the principal color-formers. The water-insoluble phase can be separated from the unwanted water solution by one or more conventional means, such as filtering, centrifuging, decanting, or the like.

However, because of the consistency of the solids resulting from the processing steps described above, a water-insoluble material which is somewhat taffy-like in consistency, effective separation by such means presents some difficulties. Dissolving the tafft-like sulfonated phenol-formaldehyde condensation product in aqueous base provides an effective means to recover the condensation product in purified form after the water-insoluble modified condensation product has been separated from the unwanted water-soluble materials which contribute to yellowing. Usually the basic solution of the taffy-like condensation product will have a fnal pH of at least about 8.0, preferably between about 8.0 and 9.5. The concentration of purified sulfonated phenol-formaldehyde condensation product in the basic solution should generally be less than about 50 weight percent, preferably between about 28 and about 30 weight percent. The taffy-like material will dissolve in aqueous base at room temperature; however, elevated temperatures effect dissolution more rapidly.

The polymeric sulfonated phenol-formaldehyde condensation products which can be used as starting materials for the purposes of this invention are any of those described in the prior art as being useful as dye-resist agents or dye-fixing agents, in other words, dye-reserving agents or agents which improve wetfastness of dyeings on polyamide fibers, see e.g. the Liss et al. application and the Blyth et al. and Ucci et al. patents, cited above, and Frickenhaus et al. U.S. Pat. No. 3,790,344. Examples of commercially available condensation products suitable for the invention are the MESITOL NBS product of Mobay Chemical Corporation (a condensation product prepared from bis-(4-hydroxyphenyl)-sulfone, formaldehyde, and phenol sulfonic acid; see U.S. Pat. No. 3,790,344), as well as Erional NW [formed by condensing a mixture of naphthalene monosulfonic acid, bis(hydroxyphenyl)-sulfone and formaldehyde; see U.S. Pat. No 3,716,393].

Any base may be used for the purposes of this invention, whether in the first or last step described above. A strong base is generally used for those purposes, but other bases may be used. Such bases include NaOH, KOH, LiOH, and the like. Organic bases, while functional, are not normally used, because of their biological oxygen demand. Similarly, virtually any acid is suitable for use in accordance with this invention, e.g. glacial acetic acid, dilute acetic acid, HCl, sulfuric acid, oxalic acid, citric acid, sulfamic acid, and the like, with glacial acetic acid being preferred. On the other hand, nitric acid is to be avoided because it can effect nitration. The acid does not effect acylation; it simply reduces the pH of the solution of sulfonated phenol-formaldehyde condensation products and thereby causes the formation of a slurry from it.

The purified condensation products of this invention can be applied to dye or undyed textile substrates. Likewise, they can be applied to such substrates in the absence of a polyfluoroorganic oil-, water-, and/or soil-repellent materials. In the alternative, such a polyfluoroorganic material can be applied to the textile substrate before or after application of the purified condensation product thereto. The quantities of purified condensation products applied to the textile substrate can be varied widely. In general, one can use between 0.5 and 5% by weight of the condensation product, based on the weight of the textile substrate. Usually the amount will not exceed 2%. The purified condensation product can be applied, as is common in the art, at pHs ranging between 4 and 5. However, more effective exhaust deposition can be obtained at a pH as low as 2. When a pH of 2 is used, the preferred level of application to the textile substrate is about 0.6% by weight, based on the weight of the textile substrate.

The purified condensation products of this invention can also be applied in-place to polyamide carpeting which has already been installed in a dwelling place, office or other locale. They can be applied as a simple aqueous preparation of in the form of aqueous shampoo preparation, with or without one or more polyfluoroorganic oil-, water-, and/or soil-repellent materials. They may be applied at the levels and temperatures described above, and at a pH between about 1 and 12, preferably between about 2 and 9.

The following Example is illustrative of the invention. Unless otherwise indicated, all parts and percentages are by weight and temperatures in the Exaample and Tests are in degrees Celsius. In the Example that follows, stain resistance and yellowing were measured by the techniques described below.

Exhaust Application of Stain-Resists to Carpeting Launder-O-Meter Method

Exhaust application of a stain-resists to carpeting is carried out in a Launder-O-Meter automated dyeing machine. One carpet piece is contained in each of several (up to twenty) stainless steel, screw-cap canisters. The canisters are held in a rack that rotates in a water bath whose temperature is automatically controlled for rate of heating, time at temperature and cooling. For a typical application bath, one uses a 20 to 1 liquor to goods ratio with 2.5 weight % of the stain-resistant composition. The stain-resistant compositions can be applied at pH 2 or pH 5. At pH 2, an excess of sulfamic acid is used. At pH 5, an excess of ammonium sulfate is used, as well as 3 g/L of magnesium sulfate and 1 g/L of an alkyl aryl sulfonate (Alkanol ®ND) or a suitable leveling agent. After the bath is made up, a solution of the stain-resist composition is added to the Launder-O-Meter canister. The carpet sample to be treated is then placed in the canister, tufted side out, the size of the carpet sample, relative to the size of the canister, being such that the no portion of the sample touches another portion of the sample. The canisters are placed in the Launder-O-Meter and the water bath temperature is held at 110° F. for 5 minutes. The temperature of the water bath is then raised to the desired temperature for application of the stain-resist composition. For application at pH 2, the temperature of the water bath is raised at 170° F.±5° F., and for application at pH 5, the temperature of the water bath is raised to 200° F.±5° F. After the bath water reaches the desired temperature, it is held there for 20 min. and then cooled to 100° F. The treated carpet sample is removed from the canister and rinsed by squeezing in deionized water at room temperature. Three successive rinses in fresh deionized water are given, each rinse being at 40 volumes of water per volume of sample. The rinsed carpet sample is centrifuged to remove excess liquid and dried at 200° F. in a forced draft oven for 30 minutes. The dry carpet sample can then be tested by use of the tests described below.

Stain Test

The Stain Test is used to measure the extent to which carpeting is stained by a commercial beverage composition which contains FD&C Red Dye No. 40 (an acid dye). The staining liquid, if solid commercially as a liquid, is used as is. Usually the commercial product is in the form of a solid. In that event, the beverage preparation, in dry, solid form, is dissolved in deionized water so as to provide 0.1 g of FD&C Red Dye No. 40 per liter of water. Sufficient wetting agent (Du Pont Merpol ®SE liquid nonionic ethylene oxide condensate) is added to the dye solution to provide 0.5 g of the wetting agent per liter of dye solution. Unless otherwise specified, the test sample is DuPont type 1150 Nylon 6,6 (white); Superba heatset, mock dyed level loop carpet, $\frac{3}{8}$ inch pile height, 30 ounces per yard, 1/10 inch gauge, 10 stitches per inch, woven polypropylene primary backing. The test sample is wetted completely with water, and excess water is removed by centrifuging. The damp sample is placed tufted face down in a pan and covered with ten times its face weight of stain fluid. Entrained air is expelled from the sample by squeezing or pressing. The sample is turned over and again the air is expelled. The sample is then returned to a face down position, and the pan is covered for storage for desired test period, namely 30 minutes or 24 hours. The stored stain sample is rinsed in running cool water until no more stain is visually detectable in the rinse water. The rinsed sample is extracted in a centrifuge and dried at 200 degrees F. Staining is evaluated with the Minolta Chroma Meter tristimulus color analyzer in the L*A*B Difference Mode with the target sample set for the unstained carpet. The "a" value is a measure of redness; for a 30 minute test, that obtained on an untreated carpet is greater than about 20, and for a 24 hour test it may be as high as 43 (but in any event, greater than about 35).

UV YELLOWING TEST

The light-fastness of carpet samples treated with a stainblocker is determined by exposing the treated samples to UV light for 20 Hours. A sample piece of carpet that has been treated with a stain-blocker is placed in a box containing in its hinged top a standard fluorescent fixture fitted with two forty watt lamps. Centered under the pair of lamps in the bottom of the box is a sliding tray having a 3 inch×40 inch recess for holding carpet specimens. The depth of the recess is such that the distance from the carpet face to the plane defined by the lamp surfaces is 1 inch. The current to the lamp is controlled by a timer so that a twenty-hour period of exposure can be obtained automatically. After the twenty-hour exposure period, the reflectance of CIE White Light Source C from the carpet is compared with the reflectance from an unexposed sample and the CIELAB delta "b" noted. Delta "b" is a measure of the yellow component of white light. A Minolta Chroma Meter model CR-110 reflectance meter is used to make the measurements and to calculate delta "b" automatically from stored data on the unexposed sample. The value of "b" is reported as the measure of yellowing with increasing positive values of "b" corresponding to increased degrees of yellowing.

The Minolta Chroma Meter is used in the Hunter L*a*b color-deviation measuring mode [Richard Hunter, "Photoelectric Colorimetry with Three Filters," J. Opt. Soc. Am., 32, 509–538 (1942)]. In the measuring mode, the instrument measures the color differences between a "target" color, whose tristimulus color values have been entered into the microprocessor as a reference, and the sample color presented to the measured head of the instrument. In examining carpet samples for yellowing and for FD&C Red Dye No. 40 staining, the "target" color entered is that of the carpet before yellowing or staining. The color reflectance of the yellowed or stained carpet is then measured with the instrument and reported as:

*E, the total color difference, *L, the lightness value,

*a, the redness value, if positive, or greenness, if negative, and

*b, the yellowness value, if positive, or blueness, if negative.

EXAMPLE 1

To 195 g of water and 30 g of 30% NaOH was added 100 g of a commercial available sulfonated phenol-formaldehyde condensation product (Mesitol NBS). The resulting solution had a pH of 9.8. Glacial acetic acid, 25 g, was added to the polymer solution while keeping the temperature below 40°, causing the polymer to precipitate and the pH to drop to 5.9. The slurry was heated to 54°, at which temperature a taffy-like material formed and settled to the bottom of the vessel. Heating was continued to 65°, and held at that temperature for 5 minutes. After cooling to 45°–50° for ease of handling, the supernatant salt water solution was siphoned out (202 g). The residual taffy was dissolved in 120 g of water and 30 g of 30% NaOH. After heating the resulting solution for one hour at 90°–100°, the product was cooled giving 290 g of an aqueous solution containing 32% of purified condensation product, and having a pH of 8.8 and a clear solubility as a 10% solution in 4° C. water. The purified product contained 3.6% bis-hydroxyphenyl sulfone and 0.8% of phenol-sulfonic, as determined by HPLC. End-use testing gave:

Initial discoloration 2.84;

24-hour stain 4.82;

Shampoo test/stain 15.98;

UV discoloration 1.40.

I claim:

1. A process for removing color-formers from polymeric sulfonated phenol-formaldehyde condensation products so as to provide condensation products having reduced tendencies to turn yellow and which will provide stain-resistance to polyamide textile substrates which comprises (a) dissolving a polymeric sulfonated phenol-formaldehyde condensation product in an aqueous base, (b) acidifying the resulting aqueous solution so as to form a slurry, (c) heating the slurry so as to form a system having at least two phases comprising an aqueous solution and a water-insoluble taffy-like material, (d) separating the aqueous solution and the water-insoluble material from one another, and (e) dissolving the water-insoluble material in an aqueous base.

2. The process of claim 1 wherein said base used in steps (a) and (e) is NaOH.

3. The process of claim 1 wherein glacial acetic acid is used in step (b) to acidify said aqueous solution and thereby effect formation of said slurry.

4. A process for removing color-formers from polymeric sulfonated phenol-formaldehyde condensation products so as to provide condensation products having reduced tendencies to turn yellow and which will provide stain-resistance to polyamide textile substrates which comprises (a) dissolving a polymeric sulfonated phenol-formaldehyde condensation product in water at a pH between about 8.0 and about 12 to give an aqueous solution containing between about 10 and about 40 weight percent of said condensation product, (b) acidifying the resulting aqueous solution to a pH in the range between about 2.0 and 7.5 so as to form a slurry, (c) heating said slurry to a temperature in the range between about 50° and about 65° C. as so to form a system having at least two phases comprising an aqueous solution and a water-insoluble taffy-like material, (d) separating the aqueous solution and water-insoluble taffy-like material from one another, and (e) dissolving the water-insoluble material in water at a pH of at least about 8.0 to give a solution having a concentration of purified sulfonated phenol-formaldehyde condensation product of less than about 50 weight percent.

5. The process of claim 4 wherein NaOH is used in steps (a) and (e) to provide the alkaline pH's recited therein.

6. The process of claim 4 wherein glacial acetic acid is used in step (b) to acidify said aqueous solution and thereby effect formation of said slurry.

7. A process for removing color-formers from polymeric sulfonated phenol-formaldehyde condensation products so as to provide condensation products having reduced tendencies to turn yellow and which will provide stain-resistance to polyamide textile substrates which comprises (a) dissolving a polymeric sulfonated phenol-formaldehyde condensation product in water at a pH between about 9.5 and about 10.0 to give an aqueous solution containing between about 25 and about 30 weight percent of said condensation product, (b) acidifying the resulting aqueous solution to a pH in the range between about 5.5 to about 6.5 so as to form a slurry, (c) heating said slurry to a temperature in the range between about 50° and about 55° C. so as to from a system having at least two phases comprising an aqueous solution and a water-insoluble taffy-like material, (d) separating the aqueous solution and water-insoluble taffy-like material from one another, and (e) dissolving the water-insoluble material in water at a pH between about 8.0 and about 9.5 to give a solution having a concentration of purified sulfonated phenol-formaldehyde condensation product of between about 28 and about 30 weight percent.

8. The process of claim 7 wherein NaOH is used in steps (a) and (e) to provide the alkaline pH's recited therein.

9. The process of claim 7 wherein glacial acetic acid is used in step (b) to acidify said aqueous solution and thereby effect formation of said slurry.

10. The process of claim 9 wherein NaOH is used in steps (a) and (e) to provide the alkaline pH's recited therein.

11. A polyamide textile substrate having deposited thereon an amount effective to provide stain-resistance of the product of claim 1.

12. A polyamide textile substrate having deposited thereon an amount effective to provide stain-resistance of the product of claim 2.

13. A polyamide textile substrate having deposited thereon an amount effective to provide stain-resistance of the product of claim 3.

14. A polyamide textile substrate having deposited thereon an amount effective to provide stain-resistance of the product of claim 4.

15. A polyamide textile substrate having deposited thereon an amount effective to provide stain-resistance of the product of claim 5.

16. A polyamide textile substrate having deposited thereon an amount effective to provide stain-resistance of the product of claim 6.

17. A polyamide textile substrate having deposited thereon an amount effective to provide stain-resistance of the product of claim 7.

18. A polyamide textile substrate having deposited thereon an amount effective to provide stain-resistance of the product of claim 8.

19. A polyamide textile substrate having deposited thereon an amount effective to provide stain-resistance of the product of claim 9.

20. A polyamide textile substrate having deposited thereon an amount effective to provide stain-resistance of the product of claim 10.

* * * * *